US005390572A

United States Patent [19]

Gakhar et al.

[11] Patent Number: 5,390,572

[45] Date of Patent: Feb. 21, 1995

[54] TOOL WITH IMMPROVED IMPACT AND TORQUE CAPABILITIES AND HAVING ERGONOMIC HANDLE

[75] Inventors: Ved P. Gakhar; Wilfred M. McCord, both of Louisville, Ky.

[73] Assignee: Vermont American Corporation, Louisville, Ky.

[21] Appl. No.: 94,274

[22] Filed: Jul. 27, 1993

[51] Int. Cl.[6] ..... B25B 15/00

[52] U.S. Cl. ..... 81/436; 81/900; 81/492; 81/177.1; 16/111 R; 30/85

[58] Field of Search ..... 81/177.1, 436, 489, 81/492, 900; 76/114; 16/110 R, 111 R; 30/85

[56] References Cited

U.S. PATENT DOCUMENTS 2,609,851 9/1952 Hadfield .
2,871,899 2/1959 Coyle et al. .
3,189,069 6/1965 Stowell .
3,302,673 2/1967 Forsberg .
4,969,231 11/1990 Mader et al. ..... 81/177.1 X
5,107,590 4/1992 Burout et al. ..... 30/85

*Primary Examiner*—James G. Smith
*Attorney, Agent, or Firm*—Middleton & Reutlinger

[57] ABSTRACT

A tool with improved impact and torque capabilities and having ergonomic handle. The tool may be a screwdriver, chisel, or the like. For example, the tool shank has a hex shaped portion integral to the two part ergonomic handle, which, with the dual molded handle composition, provides these increased tool capabilities. The ergonomic handle has a polypropylene core molded about the shank and a thermoplastic rubber cushion grip molded about the polypropylene core.

18 Claims, 1 Drawing Sheet

TOOL WITH IMMPROVED IMPACT AND TORQUE CAPABILITIES AND HAVING ERGONOMIC HANDLE

BACKGROUND OF THE INVENTION (a) Field of the Invention

The present invention relates to a tool with improved impact and torque capabilities and having ergonomic handle. The tool may be a screwdriver, chisel, or the like. For example, the tool shank has a hex shaped portion integral to the two part ergonomic handle, which, with the dual molded handle composition, provides these increased tool capabilities. The ergonomic handle has a polypropylene core molded about the shank and a thermoplastic rubber cushion grip molded about the polypropylene core.

(b) Description Of the Prior Art

It is known in the art to provide a screwdriver shank having wings, or flattened portions, on the shank portion included in the handle of the screwdriver. The wings function when the screwdriver handle is being rotated or torqued to transfer the torquing forces to the shank and to prevent the shank from turning within the handle.

If the end of the tool handle is hit by, for example, dropping a screwdriver handle down onto a hard surface or hitting a chisel on the handle, the shank portion extending into the handle can cause the handle to fail, ruining the tool. One method of overcoming this is to extend the shank through the handle. Another method is to provide a flared out bolster portion of the shank at the handle base toward the tool end, such as taught by Forsberg in U.S. Pat. No. 3,302,673. However, experience has shown that, while the flared out bolster portion absorbs some of the forces, the handle can still fail.

While Forsberg teaches a flared out bolster, it is also known to shape the bolster at the tool base of the screwdriver handle, for example in a hexagonal shape, so that an external tool, such as a wrench, can be used to assist the hand in torquing or turning the screwdriver.

To increase torquing capabilities, screwdrivers having a handle, for example of cellulose plastic, are known having a sleeve thereover. Coyle U.S. Pat. No. 2,871,899, et al., teaches such a sleeve 15 of resilient rubber-like material having a durometer reading of between 40 and 90 Shore A. More particularly, a sleeve of neoprene rubber, having a durometer reading of between 55 and 70 Shore A, is taught. Coyle teaches that the sleeve can be held in place on the handle simply by friction, or it may be adhesively cemented thereto. To aid in torquing, Coyle also teaches mechanical interlocking of the sleeve and handle by having mating grooves and ribs on the inside of the sleeve and outside of the handle, respectively. Stowell U.S. Pat. No. 3,189,069, teaches another handle body having a fluted grip 24 frictionally received thereover.

Older known screwdriver shanks, before handles were attached thereto and, thus, before shank wings, are known having a head on the end opposite the tool end. Hadfield U.S. Pat. No. 2,609,851, to teaches a small screwdriver having such a head 16 on shank 14, which has been molded into a handle 15. This head 16 functions as the currently used shank wings, in that it helps prevent the shank 14 from turning in handle 15.

SUMMARY OF THE INVENTION

The present invention is for a tool with improved impact and torque capabilities and having an ergonomic handle. The handle comprises a harder inner core of molded polypropylene thermoplastic resin having a filler of calcium carbonate ($CaCO_3$), for example, therein. Many other fillers can be used, such as, for example, glass fibers and talc.

The core is partway surrounded by a softer molded cushion grip of thermoplastic rubber, also of olefin base. Slots in the core and manufacturing the preferred core and grip both from propylene based polymers improves mechanical and chemical bonding between the core and grip and enhances torquing capabilities. Adding between about 20–50% $CaCO_3$, and preferably about 40% in the core improves the modulus of the core and thereby improves torquing, as the shank wings are less likely to cause the core to fail with the $CaCO_3$ included.

The shank end of a tool can absorb impact forces exerted onto the handle, for example, from a user dropping a screwdriver onto a hard surface handle down, from an unsafe user misusing or abusing a screwdriver by hitting its handle, or from a user hitting the handle of a chisel. To improve impact capabilities, the shank end is increased in surface area by press fitting a hex nut, for example, onto the handle end of a typical tool shank. Preferably, the hex nut is pressed onto the shank to engage the shank wings. The nut and wings are molded into the handle. This increased surface area in a plane generally parallel to the blow will spread the blow forces over a larger surface area, thereby making the handle less likely to fail. Further, being a hex nut, the torquing capabilities are also enhanced. This unique combination of nut and dual molded handle provides a tool having improved impact and torque capabilities. If fact, with this combination, it is the tool tip which generally fails under impact and torque, not the handle and the shank therein.

More particularly, the present invention comprises a tool having a shank with a tool end and a handle end, the shank having a first impact surface area toward the handle end, the shank having means for increasing the impact surface area toward the handle end; and, a handle having an inner core portion having a first hardness and an outer grip portion having a second hardness, the outer grip portion extending at least partway around the inner core portion, the first hardness being harder than the second hardness, the inner core portion extending around the shank means for increasing the impact surface area toward the handle end.

Even more particularly, the present invention comprises a tool having a shank with a tool end and a handle end, the shank having a plurality of axially-aligned wings positioned toward the handle end; a hexagonal-shaped nut press fitted securely onto the shank handle end and engaging the shank wings; and, a handle having an inner core portion having a first hardness and an outer grip portion having a second hardness, the outer grip portion extending at least partway around the inner core portion, the first hardness being harder than the second hardness, the inner core portion extending around the shank wings and the nut, the inner core portion having a plurality of slots therein; wherein the inner core portion comprises polypropylene having a filler material added thereto; and wherein the outer grip portion of the handle comprises a thermoplastic rubber, the second hardness having a durometer hardness reading of between 45 and 90 Shore A.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

The present invention is for a tool with improved impact and torque capabilities and having an ergonomic handle. For the preferred embodiment, the tool shown in the figures and described is a screwdriver. However, expanding the shank impact surface area and providing a dual molded handle with both handle materials of an olefin base has broad application in the tool area, such as, for example, with chisels. The screwdriver is simply used for explaining the invention and is in no way meant to be limiting.

Figure 1:
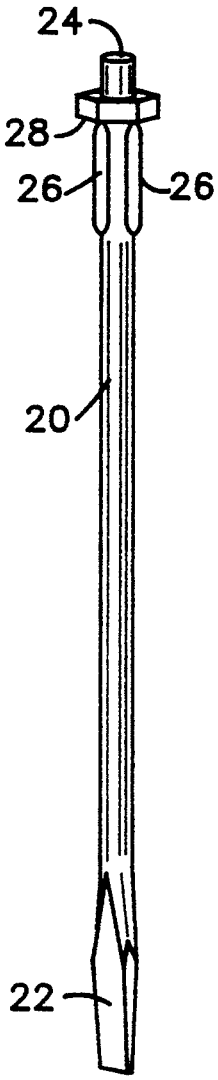
FIG. 1 shows a perspective view of the tool shank of the preferred embodiment of the present invention, the shank having a hex nut press fitted thereunto.

With reference to the figures, there is shown a tool 10, a screwdriver, having a shank 20 and a handle 40. The shank 20, seen in FIG. 1, is any typical screwdriver shank desired to be used. It may be a standard strength shank, a professional hardened shank, etc. The shank 20 has a tool tip end 22 and a handle end 24. Toward the handle end 24 are a pair of wings 26 which are provided within a typical screwdriver handle to permit the handle and shank to be torqued or rotated together. Shank 20 is shown having a hex nut 28 press fitted onto the handle end 24 thereof, the nut 28 being pressed onto shank 20 to engage the wings 26. By pressing the nut 28 to engage the wings 26, if the handle 40, described hereinafter, molded over the wings 26 and nut 28 receives a blow, the nut 28, by engaging the wings 26, and the shank handle end 24 will uniformly receive the forces from the blow. It is noted that, for this preferred embodiment, for example, when looking at the handle end 24, the addition of the nut 28 more than doubles the force receiving surface area of the shank 20. By increasing this area, there is a decreased possibility that the handle 40 will fail.

A nut 28 is preferable employed because a hex nut has a desired thickness, is a readily available item, and is available in many sizes so as to be readily useable with the plurality of different sized tool shanks. In addition to improving impact capabilities, because of its hex shape, a hex nut also improves torquing. However, to improve impact, various means can be employed to increase the impact receiving surface area toward the shank handle end 24. It is noted that the shank 20 could, for example, even have the handle end 24 "flattened" similar to a nail head. Further, instead of press fitting nut 28 onto shank 20, a hollow cylindrical sleeve or body, sized similarly to a hex nut, could by welded or otherwise secured to shank 20.

After the hex nut 28 has been press fitted onto shank 20, the shank 20 is ready to receive the handle 40. Handle 40 is a dual molded handle having a "harder" core 42, seen in FIGS. 25, and a "softer" cushion grip portion 50, seen in FIGS. 3 and 5. To enhance torquing, both core 42 and grip portion 50 are of an olefin base. Therefore, molding grip portion 50 onto core 42 provides some chemical bonding without the use of an adhesive.

Figure 2:
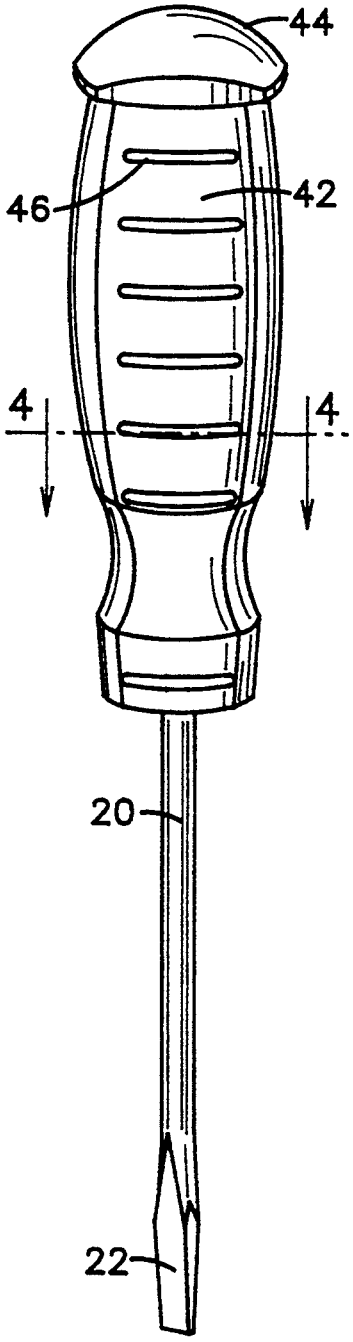
FIG. 2 shows a perspective view of the tool shank of FIG. 1 having a handle core molded thereon.

Core 42 has an exposed end portion 44. Handle core 42 also has a plurality of slots 46 therein. For example, with a handle core as sized in FIG. 2, each of the three core 42 faces have seven slots 46 therein, six being spaced approximately equidistant and a seventh slot toward the tip 22 end of core 42. However, more or less than seven slots can be employed with this, or different, sized handle cores.

Figure 4:
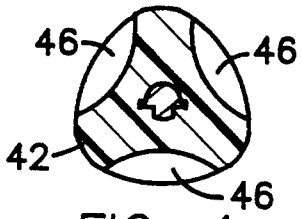
FIG. 4 shows a cross-sectional view of the tool shank with molded handle core of FIG. 2 along the lines 4–4; and, FIG. 5 shows an end view looking from the handle end toward the tool tip end of the tool of FIG. 3.

Slots 46 serve dual purposes. In the molding operation, because of the thickness of core 42, slots 46 help the core 42 cool more uniformly. Placing the slots 46 in planes which are transverse to the shank 20 axis and giving them a generally indented triangular shape, as seen best in FIG. 4, provides some mechanical bonding of grip portion 50 onto core 42 when the handle 40 is being rotated either in a clockwise or counterclockwise direction.

Figure 5:
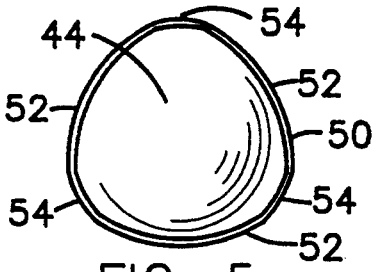
Figure 3:
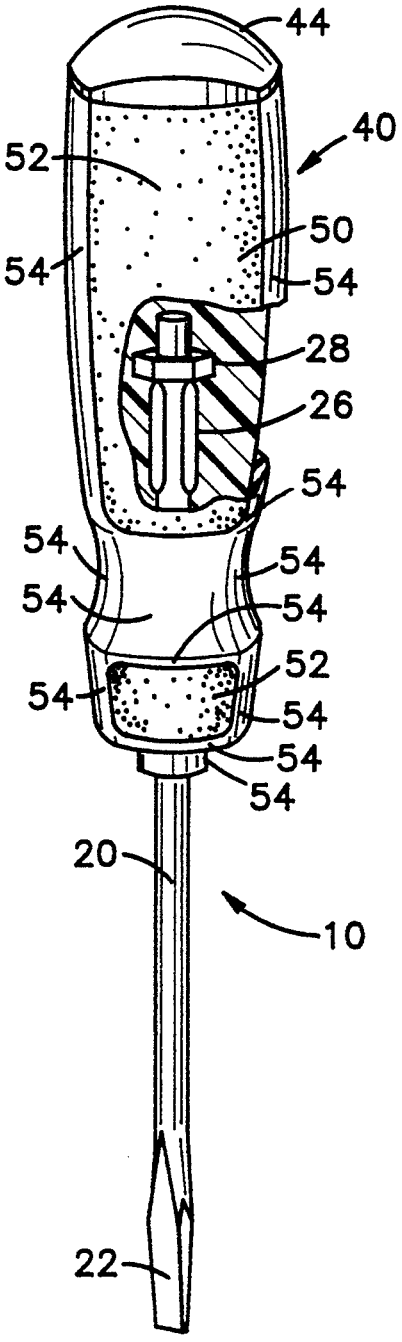
FIG. 3 shows a perspective view of the tool shank with molded handle core of FIG. 2 having a cushion grip molded thereon, selected portions being cut-away.

After core 42 has been molded, cushion grip portion 50 is molded partway therearound. As seen in FIGS. 3 and 5, end portion 44 of core 42 is left exposed. For aesthetics and for better gripping with less slipping, the mold for grip portion 50 can have etched portions so that grip portion 50 has a desired external textured appearance while also permitting better torquing. As seen, grip portion 50 is shown having rough textured portions 52 and smooth textured portions 54.

When compared to a tool having a plain cellulose plastic handle which can, for example, be brittle in cold conditions or a tool having a neoprene rubber-like sleeve over its handle which can, for example, slip on the handle during torquing when exposed to oil or moisture, it was desired to mold grip portion 50 from a thermoplastic rubber to provide a tool more useable in cold conditions, or in conditions where oil, water, or other moisture is present, to improve torquing, and to give the tool 10 user a grip which felt better in his hand. For the preferred embodiment, Monsanto's thermoplastic rubber having the trademarked name "SANTOPRENE" thermoplastic rubber is used. SANTOPRENE® is currently available in hardness grades ranging from 45 Shore A to 50 Shore D. For molding grip portion 50 to core 42 and to present a desired grip 50 feel to the tool user, it is preferred to use pellets of 45, 64, 73, or 80 Shore A hardness.

After SANTOPRENE® thermoplastic rubber was selected for the grip portion 50, a compatible material was selected for core 42 to provide improved torquing. Therefore, polypropylene thermoplastic resin was selected for molding core 42. However, testing showed that 100% polypropylene did not provide the desired torquing capabilities, as the wings 26 had a tendency to cause the hard core 42 to fail under torque. Therefore, various fillers were added to the 100% polypropylene to improve the modulus of core 42, increasing the torquing capabilities.

Adding between about 20–50% filler, such as, for example, glass fibers, talc, or $CaCO_3$, or the like, provides a desired mix, particularly when including the increased impact and torque effects of hex nut 28 pressed onto shank 20. Tests demonstrate that adding about 40% $CaCO_3$ in the core provides about the optimum capabilities for the tool 10 of the preferred embodiment.

It is noted that the handle 40 of the preferred embodiment is shown having a generally triangular cross-section with rounded vertices. Handle 40 has a slightly larger cross-sectional area toward its center than toward its ends. While other shapes are possible for the dual molded handle having core 42 and grip 50, it is believed that the shape shown presents the user with a tool 10 having an ergonomic handle having improved impact and torque capabilities.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A tool, comprising:

(a.) a shank, said shank having a tool end and a handle end, said shank having an impact surface area toward said handle end;

(b.) a body having a bore therethrough, said body being placed over said handle end of said shank, said body securely fitting onto said shank, said body providing means for increasing said impact surface area toward said handle end; and, (c.) a unitary molded handle, said handle having an inner core portion having a first hardness, said handle having an outer grip portion having a second hardness, said outer grip portion extending at least partway around said inner core portion, said first hardness being harder than said second hardness, said inner core portion being molded about said shank to envelop said handle end and said body and wherein said outer grip portion is molded at least partway around said inner core portion.

2. The tool of claim 1, wherein said inner core portion comprises polypropylene.

3. The tool of claim 2, wherein a filler material is added to said polypropylene comprising said inner core portion.

4. The tool of claim 3, wherein said filler material comprises between 20% and 50% of said inner core portion.

5. The tool of claim 4, wherein said filler material comprises 40% of said inner core portion.

6. The tool of claim 3, wherein said filler material is selected from the group consisting of calcium carbonate, glass fibers, and powdered talc.

7. The tool of claim 3, wherein said filler material is calcium carbonate.

8. The tool of claim 7, wherein said calcium carbonate comprises 40% of said inner core portion.

9. The tool of claim 2, wherein said outer grip portion of said handle comprises a thermoplastic rubber.

10. The tool of claim 9, wherein said second hardness has a durometer hardness reading of between 45 and 90 Shore A.

11. The tool of claim 9, wherein said thermoplastic rubber is selected from the group consisting of SANTOPRENE thermoplastic rubber having a durometer hardness reading of 45 Shore A, SANTOPRENE thermoplastic rubber having a durometer hardness reading of 64 Shore A, SANTOPRENE thermoplastic rubber having a durometer hardness reading of 73 Shore A, and SANTOPRENE thermoplastic rubber having a durometer hardness reading of 80 Shore A.

12. The tool of claim 9, wherein said thermoplastic rubber comprises SANTOPRENE thermoplastic rubber and wherein said second hardness has a durometer hardness reading of 64 Shore A.

13. The tool of claim 9, wherein said thermoplastic rubber comprises SANTOPRENE thermoplastic rubber and wherein said second hardness has a durometer hardness reading of 80 Shore A.

14. The tool of claim 1, wherein said body comprises a hex-shaped nut.

15. The tool of claim 1, wherein said shank further comprises a plurality of axially-aligned wings positioned toward said handle end, said handle inner core portion extending around said wings, and wherein said body comprises a hex-shaped nut, said hex-shaped nut and said wings being in an abutting relationship.

16. A tool, comprising:

(a.) a shank, said shank having a tool end and a handle end, said shank having an impact Surface area toward said handle end, said shank having a plurality of axially-aligned wings positioned toward said handle end;

(b.) a hexagonal-shaped nut, said nut being press fitted securely onto said handle end of said shank, said nut engaging said shank wings, said nut providing means for increasing said impact surface area toward said handle end; and, (c.) a unitary handle, said handle having an inner core portion having a first hardness, said handle having an outer grip portion having a second hardness, said first hardness being harder than said second hardness, said inner core portion being molded about said shank to envelop said handle end and said shank wings and said nut, said inner core portion having a plurality of slots therein, said outer grip portion being molded at least partway around said inner core portion to envelop said plurality of slots; wherein said inner core portion comprises polypropylene

17. The tool of claim 16, wherein said filler material comprises between 20% and 50% of said inner core portion and wherein said filler material is selected from the group consisting of calcium carbonate, glass fibers, and powdered talc.

18. The tool of claim 16, where said plurality of slots in said inner core are transverse to said shank, said slots receiving a portion of said molded thermoplastic rubber outer grip portion therein.

* * * * *

UNITED STATES PATENT AND TRADEMARK OFFICE

CERTIFICATE OF CORRECTION

PATENT NO. : 5,390,572

DATED : Feb. 21, 1995

INVENTOR(S) : Ved P. Gakhar, Wilfred M. McCord, Jr.

It is certified that error appears in the above-indentified patent and that said Letters Patent is hereby corrected as shown below:

On the title page, item [54] delete "IMMPROVED" insert --IMPROVED-- item [75] after McCord, insert --Jr.--

Column 1 Line 1 delete "IMMPROVED" insert --IMPROVED--

Column 4 Line 1 delete "by" insert --be--

Column 4 Line 6 delete "25" insert --2-5--

Column 4 Line 50 delete "thermoplastic rubber"

Column 4 Line 50 after SANTOPRENE® insert--thermoplastic rubber--

UNITED STATES PATENT AND TRADEMARK OFFICE

CERTIFICATE OF CORRECTION

PATENT NO. : 5,390,572

DATED : Feb. 21, 1995

INVENTOR(S) : Ved P. Gakhar, Wilfred M. McCord, Jr.

It is certified that error appears in the above-indentified patent and that said Letters Patent is hereby corrected as shown below:

Column 6 Line 31 delete "Surface" insert --surface--

Column 6 Line 51 after polypropylene insert --having a filler material added thereto; and wherein said outer grip portion of said handle comprises a thermoplastic rubber, said second hardness having a durometer hardness reading of between 45 and 90 Shore A.

Signed and Sealed this

Nineteenth Day of March, 1996

*Attest:*

Bruce Lehman

BRUCE LEHMAN

*Attesting Officer*

*Commissioner of Patents and Trademarks*